United States Patent [19]

Kamifuji et al.

[11] Patent Number: 4,522,175

[45] Date of Patent: Jun. 11, 1985

[54] ROTATIONAL SPEED CONTROL APPARATUS FOR INTERNAL COMBUSTION ENGINES

[75] Inventors: Hiroshi Kamifuji; Tomoo Ito; Chiaki Niida, all of Katsuta, Japan

[73] Assignee: Hitachi, Ltd., Tokyo, Japan

[21] Appl. No.: 598,740

[22] Filed: Apr. 10, 1984

[30] Foreign Application Priority Data

Apr. 11, 1983 [JP] Japan ..... 58-62296

[51] Int. Cl.[3] ..... F02N 3/06

[52] U.S. Cl. ..... 123/339; 123/360; 123/198 D

[58] Field of Search ..... 123/339, 360, 198 D, 123/198 DB; 180/171, 176, 177

[56] References Cited

U.S. PATENT DOCUMENTS 3,741,332 6/1973 Sakakibara et al. ..... 123/198 D X
3,850,151 11/1974 Mawatari et al. ..... 123/198 D X
3,937,194 2/1976 Tamaki et al. ..... 123/198 D X
4,300,501 11/1981 Suzuki ..... 123/339

FOREIGN PATENT DOCUMENTS 131328 8/1983 Japan ..... 123/339

*Primary Examiner*—Tony M. Argenbright
*Attorney, Agent, or Firm*—Antonelli, Terry & Wands

[57] ABSTRACT

In a rotational speed control apparatus for an internal combustion engine in which a signal-responsive diaphragm, whose controlling position is determined by a controlled negative pressure signal, is provided with a valve member controlling to negative pressure acting upon a driving diaphragm controlling the opening of a throttle valve, the negative pressure acting upon the driving diaphragm, when the controlled negative pressure signal is detected to be not normal, is controlled to be shifted to the level at which the driving diaphragm is rendered substantially non-operable.

5 Claims, 3 Drawing Figures

ROTATIONAL SPEED CONTROL APPARATUS FOR INTERNAL COMBUSTION ENGINES

This invention relates to an apparatus for controlling the rotational speed of an internal combustion engine, especially, that mounted on an automotive vehicle.

In an apparatus for controlling, for example, the idling rotational speed of an internal combustion engine, the temperature of an engine cooling water and the rotational speed of the engine during idling are sensed, and the quantity of air supplied to the engine is regulated so that the actual idling rotational speed of the engine is controlled to approach the desired idling rotational speed corresponding to the sensed cooling water temperature.

As one of prior art methods for regulating the quantity of air for the purpose of such idling speed control, it is known to regulate the opening of the throttle valve disposed in the intake passage of an engine.

As means for regulating the opening of the throttle valve, an apparatus as, for example, disclosed in U.S. patent application Ser. No. 500,906 entitled "PRESSURE SERVOMOTOR AND THROTTLE VALVE OPENING CONTROLLER MAKING USE OF PRESSURE SERVOMOTOR APPARATUS" and filed by the assignee of the present application.

Although the proposed apparatus is quite excellent in its function of throttle valve position control, the use of diaphragms in both of the drive mechanism and the control mechanism controlling the position of the drive mechanism may give rise to such a trouble that the control diaphragm constituting part of the control mechanism may be damaged or the hose connected to the control mechanism to apply a controlled negative pressure to this control diaphragm may be disconnected.

Therefore, such a rotational speed control apparatus is desirably provided with an additional function or a safety ensuring function so that, in the event of occurrence of such a trouble, the drive mechanism can restore the throttle valve to the position of safe opening, for example, the opening corresponding to the idling rotation of the engine.

It is therefore a primary object of the present invention to provide a novel and improved rotational speed control apparatus for an engine, in which means are provided so that the drive mechanism can restore the throttle valve to the position of safety opening even in the event of occurrence of an abnormal or dangerous condition in the control mechanism.

The present invention is featured by the fact that a non-controllable state of the control mechanism is detected, if such a state might occur, thereby placing the drive mechanism in a non-operable state so as to avoid the danger.

In accordance with a preferred aspect of the present invention, there is provided a rotational speed control apparatus for an internal combustion engine comprising: a throttle valve disposed in an intake pipe; a driving diaphragm arranged for interlocking operation with the throttle valve through an actuating shaft for driving the throttle valve; a driving negative pressure chamber defined by the driving diaphragm and a front cover; a driving negative pressure passage connecting the driving negative pressure chamber to the intake pipe at a position downstream of the throttle valve for introducing a driving negative pressure into the driving negative pressure chamber; a signal-responsive diaphragm provided with an air regulating valve member regulating the quantity of air introduced into the driving negative pressure chamber through an air passage opening into the driving negative pressure chamber; a signal negative pressure chamber defined by the signal-responsive diaphragm and an end cover; a signal negative pressure passage connecting the signal negative pressure chamber to a signal negative pressure source for introducing a controlled signal negative pressure into the signal negative pressure chamber; signal negative pressure control means including a signal negative pressure regulating valve for controlling the signal negative pressure; abnormal operation detecting means for detecting an abnormal operation occurring when the negative pressure in the signal negative pressure chamber deviates from the level set for the normal operation of the signal-responsive diaphragm; and pressure control means for controlling the internal pressure of the driving negative pressure chamber so that, when the abnormal operation detecting means detects the abnormal operation, the internal pressure of the driving negative pressure chamber is shifted to the level at which the driving diaphragm is rendered substantially non-operable.

The above and other objects, features and advantages of the present invention will become clear from the following detailed description of a preferred embodiment thereof taken in conjunction with the accompanying drawings, in which.

Figure 1:
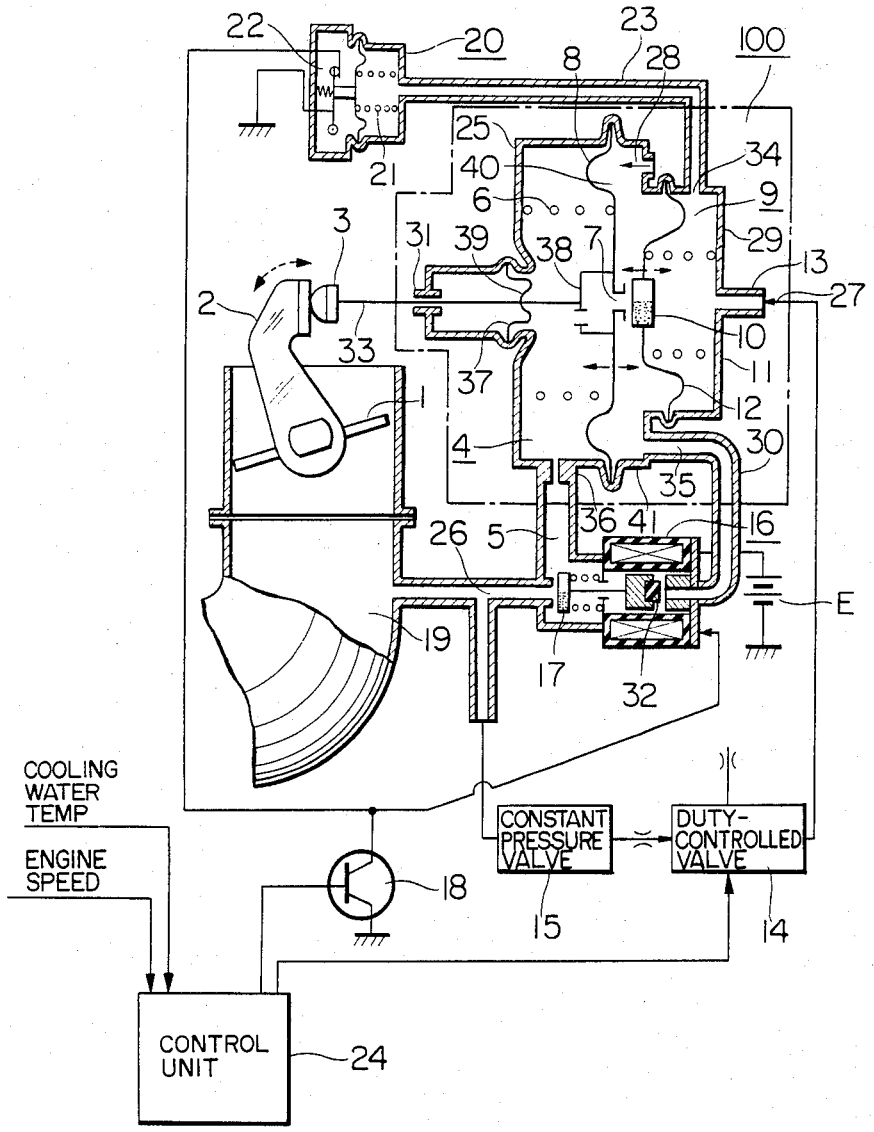
FIG. 1 is a partly sectional, diagrammatic view of a preferred embodiment of the idling rotational speed control apparatus according to the present invention.

Referring now to the drawings, FIG. 1 shows a preferred embodiment of the rotational speed control apparatus according to the present invention.

Referring to FIG. 1, the negative pressure servomotor disclosed in the cited earlier application is generally designated herein as a diaphragm mechanism 100. This diaphragm mechanism 100 includes a driving negative pressure chamber 4 and a signal negative pressure chamber 9. The driving negative pressure chamber 4 is defined by a front cover 25 and a driving diaphragm 8 and includes a spring 6 and a sealing diaphragm 37. The driving diaphragm 8 is formed with a leak passage 7, and a push shaft 33 is connected at one end thereof to the diaphragm 8 through a supporting member 38.

The sealing diaphragm 37 is sealed from the push shaft 33 by a seal 39. The push shaft 33 extends to the exterior of the driving negative pressure chamber 4 through a bearing 31 and is connected at the other end thereof to a push rod 3.

The push shaft 33 moves in the axial direction of the driving diaphragm 8 as shown by the dotted arrows, that is, toward and away from a throttle valve driving member 2, thereby causing rocking movement of the driving member 2 as shown by the dotted arrows for controlling the opening of a throttle valve 1.

The driving negative pressure chamber 4 further includes a driving negative pressure introduction passage 36 provided with an orifice, and a driving negative pressure introduction conduit 5 is connected to the passage 36.

The signal negative pressure chamber 9 is defined by an end cover 29 and a signal-responsive diaphragm 12 and includes a spring 11 and a signal negative pressure introduction passage 13. A valve member 10 is mounted on the diaphragm 12 to open and close the leak passage 7. The signal-responsive diaphragm 12 moves in its axial direction as shown by the dotted arrows, and the valve member 10 moves together with the diaphragm 12 to make the open-close control of the leak passage 7. An atmospheric pressure chamber 40 is defined between the driving negative pressure chamber 4 and the signal negative pressure chamber 9 by the diaphragms 8, 12 and an intermediate cover 41. When the leak passage 7 is closed by the movement of the valve member 10 toward the driving diaphragm 8, flow of air between the driving negative pressure chamber 4 and the atmospheric pressure chamber 40 located on the right-hand side of the leak passage 7 is interrupted or ceases. When, on the other hand, the leak passage 7 is opened by the movement of the valve member 10 away from the driving diaphragm 8, a path of air flow is established between the driving negative pressure chamber 4 and the atmospheric pressure chamber 40 depending on the relative positions of the driving diaphragm 8 and the valve member 10.

A signal negative pressure introduction conduit 27 is connected to the signal negative pressure introduction passage 13. The atmospheric pressure chamber 40 has passages 28 and 35, the passage 28 communicating with the atmosphere and the passage 35 being connected to a communication conduit 30 in which a solenoid-operated valve 16 is provided.

The signal negative pressure chamber 9 has a passage 34 provided for sensing the internal pressure of the chamber 9, and this passage 34 is connected to a pressure switch 20 by a connection conduit 23.

At the outside of the diaphragm mechanism 100 having the structure above described, there are provided a control unit 24, a constant pressure valve 15, a transistor 18 and a duty-controlled solenoid-operated valve 14, besides the solenoid-operated valve 16, the throttle valve 1, the throttle valve driving member 2 and the pressure switch 20.

The throttle valve 1 is disposed in an intake pipe 19 of an internal combustion engine so that the quantity of air flowing into the intake pipe 19 is determined by the opening of the throttle valve 1. The air pressure in the intake pipe 19, that is, the intake negative pressure is led through a connection conduit 26 to the exterior as an object to be sensed. This connection conduit 26 has two outlets connected to the solenoid-operated valve 16 and the constant pressure valve 15 respectively.

Signals indicative of the sensed cooling water temperature and engine rotational speed are applied to the control unit 24. In response to the application of these signals, the control unit 24 executes necessary processing to generate a pulse signal (a control signal) commanding an adequate duty factor and applies this duty-factor pulse signal to the duty-controlled solenoid-operated valve 14. The constant pressure valve 15 supplies a constant or controlled negative pressure to the duty-controlled solenoid-operated valve 14, and, in response to the application of the duty-factor pulse signal from the control unit 24, the duty-controlled solenoid-operated valve 14 is on-off controlled to generate a negative pressure output corresponding to the on-off state of the duty-controlled solenoid-operated valve 14. The negative pressure output from the duty-controlled solenoid-operated valve 14 is supplied as a controlled signal negative pressure to the signal negative pressure chamber 9 through the conduit 27 and passage 13.

During operation of the apparatus, the signal-responsive diaphragm 12 in the signal negative pressure chamber 9 may be damaged or the signal negative pressure introduction conduit 27 in the form of, for example, a rubber hose connecting the duty-controlled solenoid-operated valve 14 to the passage 13 may be disconnected. When such a trouble occurs, the internal pressure of the signal negative pressure chamber 9 rises up to the level of the atmospheric pressure, and the signal-responsive diaphragm 12 is urged by the spring 11 to urge the valve member 10 toward its extreme leftward position at which the throttle valve 1 is brought to its full-open position. The above movement of the valve member 10 also closes the leak passage 7. If the valve member 10 were left in such a position, the intake negative pressure would act directly on the driving diaphragm 8 to maintain the throttle valve 1 in its extreme or full-open position, and the engine rotational speed could not be decreased, resulting in a dangerous uncontrollable running of the vehicle.

To avoid such a danger, the pressure switch 20 for sensing the air pressure in the signal negative pressure chamber 9 is provided in the embodiment of the present invention. The output of the pressure switch 20 energizes the solenoid-operated valve 16.

The operation of the apparatus will now be described.

Figure 2:
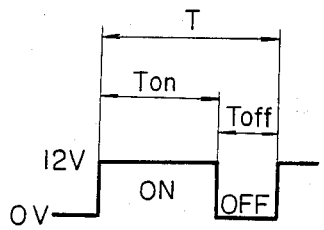
FIG. 2 shows the waveform of a duty factor pulse.
Figure 3:
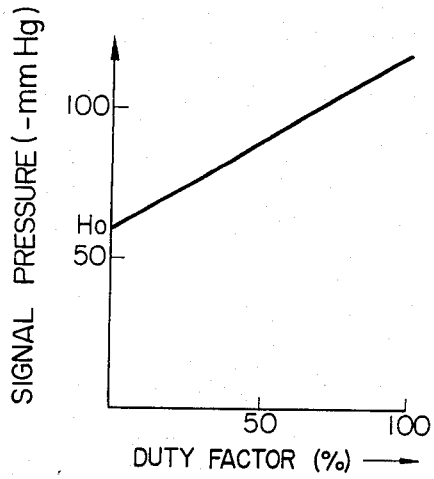
FIG. 3 is a graph showing the relation between the duty factor D and the signal negative pressure.

FIG. 2 shows the waveform of the duty-factor pulse signal generated from the control unit 24. The period T of each pulse is constant, and the ratio between the high level (on) duration $T_{ON}$ and the low level (off) duration $T_{OFF}$ changes depending on the operating parameters which include the cooling water temperature and engine rotation speed. The internal pressure of the signal negative pressure chamber 9 is changed depending on the duty factor commanded by the duty-factor pulse signal generated from the control unit 24. FIG. 3 shows the relation between the duty-factor pulse signal and the signal negative pressure. The horizontal axis of FIG. 3 represents the duty factor D which is given by $$D=(T_{ON}/T)\times 100 \quad (1)$$

The vertical axis in FIG. 3 represents the value of the signal negative pressure. It will be seen that the duty factor is 100% when $T_{ON}=T$ and 0% when $T_{ON}=0$.

On the other hand, the value of the signal negative pressure at the duty factor $D=0$ is not equal to the value of the negative pressure in the intake pipe 19 since the duty-controlled solenoid-operated valve 14 is closed in such a case.

In the embodiment, the value of the signal negative pressure at the duty factor $D=0$ is selected to be a predetermined constant $H_o$ as seen in FIG. 3. For example, the value of $H_o$ is selected to be $H_o>50$ mmHg. The value of $H_o$ can be simply determined by the designed characteristics of the constant pressure valve 15 and duty-controlled solenoid-operated valve 14.

The pressure switch 20 includes a spring 21 and a contact assembly 22. The contact assembly 22 is grounded at one terminal thereof and connected at the other terminal thereof to the coil terminal of the solenoid-operated valve 16. The pressure switch 20 is so constructed that, when the value of the signal negative pressure supplied through the connection conduit 23 is larger than $H_o$, the contacts of the contact assembly 22 are brought into electrical engagement, while when the value of the signal negative pressure is smaller than $H_o$, the contacts of the contact assembly 22 are released from electrical engagement. The electrical engagement and disengagement of the contacts of the contact assembly 22 is effected by means including the spring 21.

Therefore, when the internal pressure of the signal pressure chamber 9 is normal, its value does not become smaller than $H_o$, and the contacts of the contact assembly 22 are normally maintained in electrical engagement. In the electrically engaging position of the contacts of the contact assembly 22, the solenoid-operated valve 16 is normally energized by power supplied from a power source E. Therefore, a valve member 17 is normally biased rightward in FIG. 1 without closing the associated outlet of the connection conduit 26, and the negative pressure in the intake pipe 19 is introduced into the driving negative pressure chamber 4 through the conduits 26 and 5. At this time, the inlet of the communication conduit 30 is closed by another valve member 32.

On the other hand, when the value of the signal negative pressure becomes smaller than $H_o$, it indicates that an abnormal situation has occurred in the signal negative pressure chamber 9. This is generally attributable to, for example, breakage of the signal-responsive diaphragm 12 or disconnection of the signal negative pressure introduction conduit 27. In such an event, the value of the signal negative pressure rises up to the level of the atmospheric pressure. Due to the introduction of the atmospheric pressure into the signal negative pressure chamber 9, the contacts of the contact assembly 22 are disengaged, and no energizing current is supplied to the solenoid-operated valve 16. Consequently, the valve member 17 of the valve 16 is urged leftward to close the associated outlet of the communication conduit 26, and the valve member 32 of the valve 16 is also urged leftward to open the inlet of the communication conduit 30. As a result of closure of the outlet of the communication conduit 26, the intake negative pressure from the intake pipe 19 is not transmitted into the driving negative pressure chamber 4, and, instead, the atmospheric air flows into the driving negative pressure chamber 4 through the communication conduit 30 to introduce the atmospheric pressure into the driving negative pressure chamber 4. Since the atmospheric pressure prevails now in the driving negative pressure chamber 4, the throttle valve 1 is urged in the closing direction by the throttle valve restoring force provided by the combination of the spring 6 and the throttle valve mechanism (not shown).

Thus, in the event that the atmospheric pressure prevails in the signal negative pressure chamber 9, the throttle valve 1 can be immediately urged in the closing direction, so that an undesirable abrupt increase of the engine rotational speed which may lead to dangerous uncontrollable running of the vehicle can be prevented.

It happens sometimes that the value of the signal negative pressure becomes smaller than $H_o$ during and immediately after starting of the engine. In such a case, the result is similar to that attributable to, for example, breakage of the diaphragm 12, and stalling of the engine may happen. Stalling of the engine tends to occur because, during and immediately after starting of the engine, the value of the controlled signal negative pressure becomes smaller than $H_o$ or, more often, than 50 mmHg, and the negative pressure of required level is not introduced into the driving negative pressure chamber 4 to delay the timing of opening the throttle valve 1 after complete explosion resulting in a slow rate of increase of the engine rotational speed.

To avoid the undesirable stalling of the engine in such a stage, a switching transistor 18 is provided in the embodiment of the present invention. The control unit 24 controls the base current of this switching transistor 18.

In the engine starting stage, the control unit 24 supplies the base current to turn on the transistor 18 which is kept turned off except the engine starting stage. Therefore, the transistor 18 is turned on in the engine starting stage to establish a path of current supplied to the solenoid-operated valve 16, and the valve member 17 of the energized valve 16 is urged rightward in FIG. 1 to open the associated outlet of the communication conduit 26, thereby introducing the intake negative pressure into the driving negative pressure chamber 4. Therefore, the engine rotational speed is not decreased in the starting stage.

On the other hand, since the transistor 18 is kept turned off except the engine starting stage, the solenoid-operated valve 16 is turned on-off by the output of the pressure switch 20 only as usual.

The control unit 24 judges that the engine is in its starting stage when the rotational speed of the engine is lower than a predetermined value of, for example, 400 rpm, and/or the starter switch is turned on and then turned off after a predetermined period of time of, for example, 5 seconds.

Even if the internal pressure of the signal negative pressure chamber 9 might be abnormal due to the breakage of the diaphragm 12 at the time at which the switching transistor 18 turned on under control of the control unit 24 which has decided that the engine is in the starting stage, the switching transistor 18 is immediately turned off from the on state, and, thereafter, the pressure switch 20 functions to prevent the throttle valve 1 from being excessively opened.

Although build-up of the atmospheric pressure in the signal negative pressure chamber 9 is sensed to avoid the danger in the aforementioned embodiment, any other conditions may be sensed to avoid the danger. For example, occurrence of an abnormal situation can be identified when the rotational speed of the engine would not change regardless of a change of the duty factor of the duty-factor pulse signal. Similarly, when the rotational speed of the engine is sensed to be unusually high during processing for the control of the idling rotational speed, it may be attributable to mal-operation or failure of the signal negative pressure generator. The solenoid-operated valve 16 should be deenergized to shut off the driving negative pressure when these conditions are detected.

The control unit 24 may be provided by a microcomputer. In such a case, software may be prepared to be suitable for the judgment of the starting condition or exclusive hardware parts may be employed for that purpose.

We claim:

1. A rotational speed control apparatus for an internal combustion engine comprising:

(a) a throttle valve disposed in an intake pipe;

(b) a driving diaphragm arranged for interlocking operation with said throttle valve through an actuating shaft for driving said throttle valve;

(c) a driving negative pressure chamber defined by said driving diaphragm and a front cover;

(d) a driving negative pressure passage connecting said driving negative pressure chamber to said intake pipe at a position downstream of said throttle valve for introducing a driving negative pressure into said driving negative pressure chamber;

(e) a signal-responsive diaphragm provided with an air regulating valve member regulating the quantity of air introduced into said driving negative pressure chamber through an air passage opening into said driving negative pressure chamber;

(f) a signal negative pressure chamber defined by said signal-responsive diaphragm and an end cover;

(g) a signal negative pressure passage connecting said signal negative pressure chamber to a signal negative pressure source for introducing a controlled signal negative pressure into said signal negative pressure chamber;

(h) signal negative pressure control means including a signal negative pressure regulating valve for controlling said signal negative pressure;

(i) abnormal operation detecting means for detecting an abnormal operation occurring when the negative pressure in said signal negative pressure chamber deviates from the level set for the normal operation of said signal-responsive diaphragm; and (j) pressure control means for controlling the internal pressure of said driving negative pressure chamber so that, when said abnormal operation detecting means detects the abnormal operation, the internal pressure of said driving negative pressure chamber is shifted to the level at which said driving diaphragm is rendered substantially non-operable.

2. A rotational speed control apparatus as claimed in claim 1, wherein said abnormal operation detecting means includes a pressure switch detecting a change of the internal pressure of said signal negative pressure chamber.

3. A rotational speed control apparatus as claimed in claim 1, wherein said pressure control means includes a pressure change-over valve member acting to open and close said driving negative pressure passage.

4. A rotational speed control apparatus as claimed in claim 3, wherein said pressure control means includes an air change-over valve member acting to introduce air into said driving negative pressure chamber when said driving negative pressure passage is closed by said pressure change-over valve member.

5. A rotational speed control apparatus for an internal combustion engine comprising:

(a) a throttle valve disposed in an intake pipe;

(b) a driving diaphragm arranged for interlocking operation with said throttle valve through an actuating shaft for driving said throttle valve;

(c) a front cover and an intermediate cover disposed on the both sides respectively of said driving diaphragm for holding said driving diaphragm therebetween;

(d) a driving negative pressure chamber defined by said front cover and said driving diaphragm;

(e) a first spring disposed in said driving negative pressure chamber for normally biasing said driving diaphragm in the closing direction of said throttle valve;

(f) a signal-responsive diaphragm held between said intermediate cover and an end cover;

(g) an atmospheric pressure chamber defined by said intermediate cover and said signal-responsive diaphragm;

(h) a signal negative pressure chamber defined by said signal-responsive diaphragm and said end cover;

(i) a second spring disposed in said signal negative pressure chamber for normally biasing said signal-responsive diaphragm toward said driving diaphragm;

(j) a leak passage formed in said driving diaphragm to permit communication between said driving negative pressure chamber and said atmospheric pressure chamber;

(k) a valve member mounted on said signal-responsive diaphragm for opening and closing said leak passage;

(1) a driving negative pressure passage connecting said driving negative pressure chamber to said intake pipe at a position downstream of said throttle valve;

(m) a signal negative pressure passage introducing a controlled negative pressure into said signal negative pressure chamber;

(n) a pressure switch generating a signal indicative of an abnormal operation as soon as the internal pressure of said signal negative pressure chamber attains a predetermined setting; and (o) a solenoid-operated valve acting to close said driving negative pressure passage in response to the generation of the abnormal-operation indicative signal from said pressure switch.

* * * * *